US009724751B2

(12) United States Patent
Stahl

(10) Patent No.: US 9,724,751 B2
(45) Date of Patent: Aug. 8, 2017

(54) RIVETING TOOL FOR SETTING BLIND RIVET NUTS AND/OR BLIND RIVET SCREWS

(71) Applicant: TKR Spezialwerkzeuge GmbH, Gevelsberg (DE)

(72) Inventor: Oliver Stahl, Schwelm (DE)

(73) Assignee: TKR Spezialwerkzeuge GmbH, Gevelsberg (DE)

( * ) Notice: Subject to any disclaimer, the term of this patent is extended or adjusted under 35 U.S.C. 154(b) by 0 days.

(21) Appl. No.: 15/282,962

(22) Filed: Sep. 30, 2016

(65) Prior Publication Data

US 2017/0087621 A1 Mar. 30, 2017

(30) Foreign Application Priority Data

Sep. 30, 2015 (DE) ..... 10 2015 116 559

(51) Int. Cl.
*B21J 15/00* (2006.01)
*B21J 15/32* (2006.01)
(Continued)

(52) U.S. Cl.
CPC ..... *B21J 15/32* (2013.01); *B21J 15/043* (2013.01); *B21J 15/046* (2013.01); *B21J 15/105* (2013.01);
(Continued)

(58) Field of Classification Search
CPC ..... B25D 9/12; B25B 27/0014; B21J 15/043; B21J 15/046; B21J 15/32; B21J 15/105; B21J 15/20
(Continued)

(56) References Cited

U.S. PATENT DOCUMENTS 3,871,203 A 3/1975 Wellin
4,425,782 A * 1/1984 Todisco ..... B21J 15/043 72/114
(Continued)

FOREIGN PATENT DOCUMENTS

DE 299 14 202 U1 1/2001
DE 10 2005 022 748 A 11/2006
(Continued)

OTHER PUBLICATIONS

European Search Report in counterpart European Application No. 16190451.1 dated Feb. 28, 2017 (9 pages) (German only).

*Primary Examiner* — David B Jones
(74) *Attorney, Agent, or Firm* — Flaster/Greenberg PC

(57) ABSTRACT

The invention relates to a riveting tool for setting blind rivet nuts and/or blind rivet screws, comprising a drive piston which is able to be hydraulically adjusted from an initial position toward an end position and a drawing mandrel which is able to be brought releasably into operative connection with the drive piston and is able to be adjusted by the drive piston between a rivet receiving position and a setting position. In order to provide a riveting tool of the type mentioned in the introduction, uniform setting processes of rivets being able to be carried out thereby with a high degree of repeated accuracy, it is provided that the riveting tool for fixing the setting position of the drawing mandrel comprises a setting unit comprising a stroke limiting element which is able to be adjusted in the longitudinal axial direction of the drive piston and which is able to be brought into engagement with the drive piston.

17 Claims, 2 Drawing Sheets

(51) Int. Cl.

| | |
|---|---|
| ***B21J 15/10*** | (2006.01) |
| ***B21J 15/20*** | (2006.01) |
| ***B21J 15/04*** | (2006.01) |
| ***B25B 27/00*** | (2006.01) |
| ***B25D 9/12*** | (2006.01) |

(52) U.S. Cl.
CPC ..... *B21J 15/20* (2013.01); *B25B 27/0014* (2013.01); *B25D 9/12* (2013.01)

(58) Field of Classification Search
USPC ..... 29/243.525
See application file for complete search history.

(56) References Cited

U.S. PATENT DOCUMENTS

| | | | | |
|---|---|---|---|---|
| 7,032,281 | B1 | 4/2006 | Lin | |
| 7,155,953 | B1 * | 1/2007 | Nikkel | B21J 15/046 29/243.526 |
| 8,161,622 | B2 * | 4/2012 | King | B21J 15/043 29/243.521 |
| 8,561,275 | B2 * | 10/2013 | Wille | B25B 27/0014 29/243.523 |
| 8,672,054 | B2 * | 3/2014 | Frenken | B25D 9/12 173/169 |
| 2011/0289762 | A1 | 12/2011 | Wille | |
| 2011/0308055 | A1 | 12/2011 | Wille | |

FOREIGN PATENT DOCUMENTS

| | | | |
|---|---|---|---|
| DE | 10 2010 022 022 | A1 | 12/2011 |
| DE | 10 2010 024 610 | A1 | 12/2011 |
| WO | WO 2007/009748 | A1 | 1/2007 |

* cited by examiner

RIVETING TOOL FOR SETTING BLIND RIVET NUTS AND/OR BLIND RIVET SCREWS

BACKGROUND OF THE INVENTION

Field of the Invention

The invention relates to a riveting tool for setting blind rivet nuts and/or blind rivet screws, comprising

- a drive piston which is able to be hydraulically adjusted from an initial position toward an end position and
- a drawing mandrel which is able to be brought releasably into operative connection with the drive piston and which is able to be adjusted by the drive piston between a rivet receiving position and a setting position.

Description of Related Art

Blind rivet nuts and/or blind rivet screws are rivets which have a thread and which, for example, are used when a lower face, an inner face or a rear face of a component is not accessible or only accessible with difficulty, as is the case for example with pipes. Blind rivet nuts and/or blind rivet screws thus provide the opportunity of applying threads to components if said components have a wall thickness which is too small in order to permit the cutting of threads.

Riveting tools of the type mentioned in the introduction are used in order to fasten the blind rivet nuts and/or blind rivet screws in a convenient manner to the respective component. The rivet to be set is arranged by a defined deformation on the component by the drawing mandrel which is adjustable between the rivet receiving position and the setting position and which is connected to the drive piston of the riveting tool, said drawing mandrel having an internal or external thread which is respectively adapted to the rivet to be set. For setting the blind rivet nuts and/or the blind rivet screws, these are previously screwed onto the drawing mandrel, introduced into the previously produced opening of the component for receiving the rivet and set by the stroke of the drawing mandrel applied by the riveting tool, wherein the rivet in this case is supported on a setting head on the riveting tool.

In this case, the length of the setting movement which is determined by the adjustment path of the drawing mandrel connected to the drive piston is essential for the quality of the connection between the set rivet and the component. The adjustment path, i.e. the stroke path of the drawing mandrel from the rivet receiving position into the setting position, determines the strength of the connection of the component and rivet. The adjustment path in this case is dependent, amongst other things, on the material thickness of the components as well as the rivet used. Generally, the adjustment path in this case is controlled via hydraulic pressure. The setting movement is terminated, for example, by an automated or manual switching-off of a pump unit, if a preset pressure, which corresponds to a defined position of the drawing mandrel, is reached.

Such a pressure-controlled setting of rivets, however, has the drawback that, in particular in the case of a manual interruption to the setting process by the operator when reaching a preset pressure—it leads to setting processes of variable quality. Proceeding therefrom the object of the invention is to provide a riveting tool of the type mentioned in the introduction by which uniform setting processes of rivets may be carried out with a high degree of repeated accuracy.

BRIEF SUMMARY OF THE INVENTION

The invention achieves the object by a riveting tool having the features of claim 1. Advantageous developments of the invention are disclosed in the dependent claims.

A characterizing feature of the riveting tool according to the invention is that said riveting tool for fixing the setting position of the drawing mandrel comprises a setting unit with a stroke limiting element which is able to be adjusted in the longitudinal axial direction of the drive piston and which is able to be brought into engagement with the drive piston. The longitudinal axial direction of the drive piston in this case coincides with the adjustment direction thereof between the initial position and the end position. By a displacement of the stroke limiting element along this longitudinal axis, therefore, a mechanical stop which is able to be altered in its position is provided for the drive piston, which in a mechanical manner fixes the setting position of the riveting tool. The adjustability of the stroke limiting element provided in the longitudinal axial direction of the drive piston in this case permits a simple fixing of the setting position, wherein to this end the stroke limiting element has to be adjusted only in the direction of the drive piston or away from said drive piston. The setting position thus represents a position fixed by the stroke limiting element between the initial position and the end position of the drive piston.

The mechanical fixing of the setting position by the stroke limiting element has the advantage that by means of the riveting tool setting processes may be carried out repeatedly with an identical setting stroke. The setting process is terminated when the drive piston comes into engagement with the stroke limiting element, wherein the stroke limiting element in the setting position adjusted thereby then prevents a further displacement of the drive piston from the initial position toward the end position.

The embodiment of the stroke limiting element fixing the adjustment path of the drive piston and thus determining the setting position is, in principle, freely selectable, as is the embodiment of the adjustability provided in the longitudinal direction of the drive piston. According to a further advantageous embodiment of the invention, however, it is provided that the stroke limiting element is configured as an adjustment bush which is connected via an external thread to a latching sleeve which is fixed to a housing of the riveting tool and which is adjustable in the longitudinal axial direction of the drive piston.

According to this embodiment of the invention, the position of the adjustment bush relative to the drive piston may be fixed by screwing the adjustment bush into or respectively out of the latching sleeve, wherein the latching sleeve is fixed to a housing of the riveting tool. The adjustability of the position of the adjustment bush relative to the drive piston by a threaded connection has the advantage that the setting position may be particularly accurately adjusted. In this case the longitudinal adjustability for each revolution of the adjustment bush may be fixed by the design of the threaded connection. Moreover, the position of the adjustment bush set by the threaded connection has a greater positional security so that the setting process may be carried out with a high degree of repeated accuracy. Screwing-in the adjustment bush toward the drive piston reduces the stroke movement of the drive piston, whereas screwing-out permits a lengthened stroke movement of the drive piston. The maximum stroke movement is fixed by the end position of the drive piston in which said drive piston preferably bears against the latching sleeve.

The embodiment of the cooperation with the drive piston determining the setting position by the stroke limiting element may, in principle, take place in any manner. According to a particularly advantageous embodiment of the invention, however, it is provided that a stop surface of the adjustment bush facing the drive piston is configured to come to bear against a front face of the drive piston facing the stop surface, and in particular comprises a coating. According to this embodiment of the invention, the setting position is determined by the position in which the front face of the drive piston comes to bear against the stop surface of the adjustment bush. This embodiment of the stroke limiting represents a particularly simple and reliable fixing of the setting position of the drawing mandrel connected to the drive piston. The arrangement of a coating provided according to a particularly advantageous development on the stop surface of the adjustment bush and/or the drive piston may in this case serve to dampen the stop movement and thus prevent damage and increase the operating comfort. In this case, for example, plastics may be used as the coating.

The fixing of the stroke limiting element in the adjusted setting position may be ensured, for example, by the selection of the thread, wherein in the case of self-locking this ensures a particularly reliable positional security. According to a development of the invention, it is provided that the adjustment bush comprises latching notches which are able to be brought into engagement with latching bodies on the latching sleeve. The use of latching bodies and latching notches firstly improves the positional security of the stroke element in the adjusted position, so that rivets may be set with a high degree of repeated accuracy until the setting position is deliberately altered. Secondly an incremental adjustment of the setting position may be predetermined via the arrangement and embodiment of the latching notches. Thus the latching notches and the latching bodies may be arranged, for example, such that said latching notches and latching bodies come into engagement with one another in predetermined longitudinal increments, for example ¼ millimeter increments, and thus provide the user with haptic feedback about the adjusted position. The user-friendliness and the adjustability may be enhanced via a scaling on the adjustment bush.

The latching notches, by which the latching bodies come into engagement in predetermined positions, may be formed for example by dome-shaped depressions. According to a particularly advantageous embodiment of the invention, however, it is provided that the latching notches are formed by at least one latching groove extending in the longitudinal axial direction of the adjustment bush. The arrangement of a latching groove which is a continuous depression on the peripheral surface of the adjustment bush represents a particularly simple and comfortable option for forming the latching notches, into which the latching bodies engage after corresponding rotation of the adjustment bush. Via, amongst other things, the number and positioning of the latching notches in this case, and via the number and spacing of the latching grooves, both the latching moment and the increments between the latching positions may be fixed in any manner. In the simplest embodiment, the adjustment bush has a single latching groove which after one respective rotation comes into engagement with a single latching body. According to a particularly advantageous embodiment of the invention, however, at least two latching grooves are provided, said latching grooves being arranged diametrically opposing one another on the adjustment bush and being able to be brought into engagement with two latching bodies opposingly arranged on the latching sleeve.

The usefulness of the riveting tool provides that different drawing mandrels are able to be used, depending on the blind rivet nuts and/or blind rivet screws to be set, wherein a replacement of the drawing mandrels is designed to take place in the simplest possible manner. According to a particularly advantageous embodiment of the invention, it is provided in this case that the drawing mandrel is releasably connected to a pressure rod which extends in the longitudinal axial direction of the drive piston through the adjustment bush. According to this embodiment of the invention, the drawing tool is of two-part configuration and comprises the drawing mandrel as well as a pressure rod connected to the drawing mandrel. The pressure rod extends in this case on the side of the housing opposing the drawing mandrel through the adjustment bush and permits, therefore, the drawing mandrel to be pulled out of the housing of the riveting tool. After removing the drawing tool by the releasable connection of the drawing mandrel with the pressure rod, the drawing mandrel may be replaced in a simple manner according to the rivets to be set and then by means of the pressure rod reinserted into the housing of the riveting tool, where the drive piston is in engagement with the drawing mandrel.

The embodiment of the releasable connection of the drawing mandrel and the pressure rod in this case is, in principle, freely selectable. According to a particularly advantageous embodiment, however, it is provided that the pressure rod at its end facing the drawing mandrel has a coupling element which is configured for the releasable connection with the drawing mandrel, in particular comprises a socket retainer which is arranged in a groove and which engages in a groove on the drawing mandrel. The use of a coupling element permits the releasable connection of the drawing mandrel and the pressure rod to be designed in any manner. Thus the coupling element may be adapted to the drawing mandrel or respectively to a connecting portion of the drawing mandrel, irrespective of the design of the pressure rod. The arrangement of a groove with a socket retainer on the coupling element in this case represents a particularly simple and cost-effective as well as a reliable releasable arrangement of the pressure rod on the drawing mandrel. The connection of the coupling element to the pressure rod in this case may also take place in any manner, wherein a permanent connection is also possible. However, a screwed connection of the coupling element to the pressure rod is preferred so that optionally there is the possibility to replace the coupling element.

In addition to the use of the coupling element for the releasable arrangement of the drawing mandrel on the pressure rod, according to a further embodiment of the invention the coupling element is configured for the releasable locking to the drive piston, wherein according to a particularly advantageous embodiment the coupling element comprises to this end at least one locking element which is adjustable between a locked position and an unlocked position.

The fixing of the drawing tool consisting of the pressure rod and the drawing mandrel in the riveting tool, in particular the positioning thereof on the drive piston, may in principle take place in any manner. The embodiment of the coupling element provided according to this development for the releasable locking, however, permits the riveting tool to be designed in a particularly compact manner, since further locking elements may be dispensed with. The locked arrangement on the drive piston, wherein the locking element engages in a corresponding receiver on the drive piston, in this case ensures in a particularly advantageous manner that the drawing tool is connected in a stable manner to the drive piston and thus the movement applied by the drive piston is reliably transmitted to the drawing mandrel. Particularly advantageously, in the pulling direction the drawing mandrel bears flat with a bearing portion against the drive piston, so that the pulling forces do not have to be transmitted via the locking mechanism, and as a result the drawing mandrel may be of particularly compact design.

The design of the locking element is also freely selectable, in principle, as is the adjustment between the locked position and the unlocked position thereof. According to a particularly advantageous embodiment of the invention, however, it is provided that the locking element, in particular a latching pin, is able to be adjusted between the locked position and the unlocked position by means of an unlocking rod which extends through the pressure rod and is able to be displaced between a locked position and a released position. According to this development of the invention, an unlocking rod extending axially to the pressure rod serves to displace the locking element between the locked position and the unlocked position. The unlocking rod extends in this case through the pressure rod such that it is able to be actuated by the operator. A displacement of the unlocking rod from the locked position in which the locking elements are held by the unlocking rod in the locked position, into the released position, effects a release of the locking elements which then, for example, come out of corresponding openings on the drive piston, so that a simple removal of the drawing tool is possible.

Particularly advantageously, in this case, the unlocking rod is pretensioned toward the locked position and/or the drive piston is pretensioned toward the initial position. A pretensioning of the unlocking rod toward the locked position ensures that in the unactuated state of the unlocking rod, the locking elements remain in the locked position which thus does not result in an inadvertent removal of the drawing tool from the riveting tool. In a similar manner, the pretensioning of the drive piston toward the initial position ensures that after terminating the setting process with an associated pressure reduction, the drive piston and thus also the drawing mandrel reach the initial position so that the set blind rivet nut and/or blind rivet screw may be screwed from the drawing mandrel. To this end, particularly preferably the drawing tool is rotatably mounted in the riveting tool or respectively in the housing of the riveting tool so that if, as preferably provided, a handle arranged at the end of the pressure rod opposing the drawing mandrel is rotated after terminating the setting process, the drawing mandrel is able to be screwed from the set rivet.

According to a particularly advantageous embodiment of the invention, in this case the unlocking rod at its end opposing the coupling element may comprise a push button adjustably mounted on the handle, which permits a simple actuation of the unlocking rod. The arrangement of the push button on the handle, which may be used for rotating the drawing tool, permits the riveting tool to be of particularly compact design.

According to a further embodiment of the invention, it is further provided that a setting head arranged coaxially to the drawing mandrel is able to be releasably, in particular magnetically, fastened to the housing. The setting head is selected depending on the drawing mandrel and thus the blind rivet nut and/or blind rivet screw to be set and is adapted to the diameter thereof. The option of the releasable arrangement on the housing of the riveting tool, in particular a magnetic positional security, ensures a simple and rapid replacement of the setting head in the case of replacement of the drawing mandrel.

BRIEF DESCRIPTION OF THE SEVERAL VIEWS OF THE DRAWING(S)

An exemplary embodiment of the invention is described hereinafter with reference to the drawings. In the drawings.

DETAILED DESCRIPTION OF THE INVENTION

Figure 1:
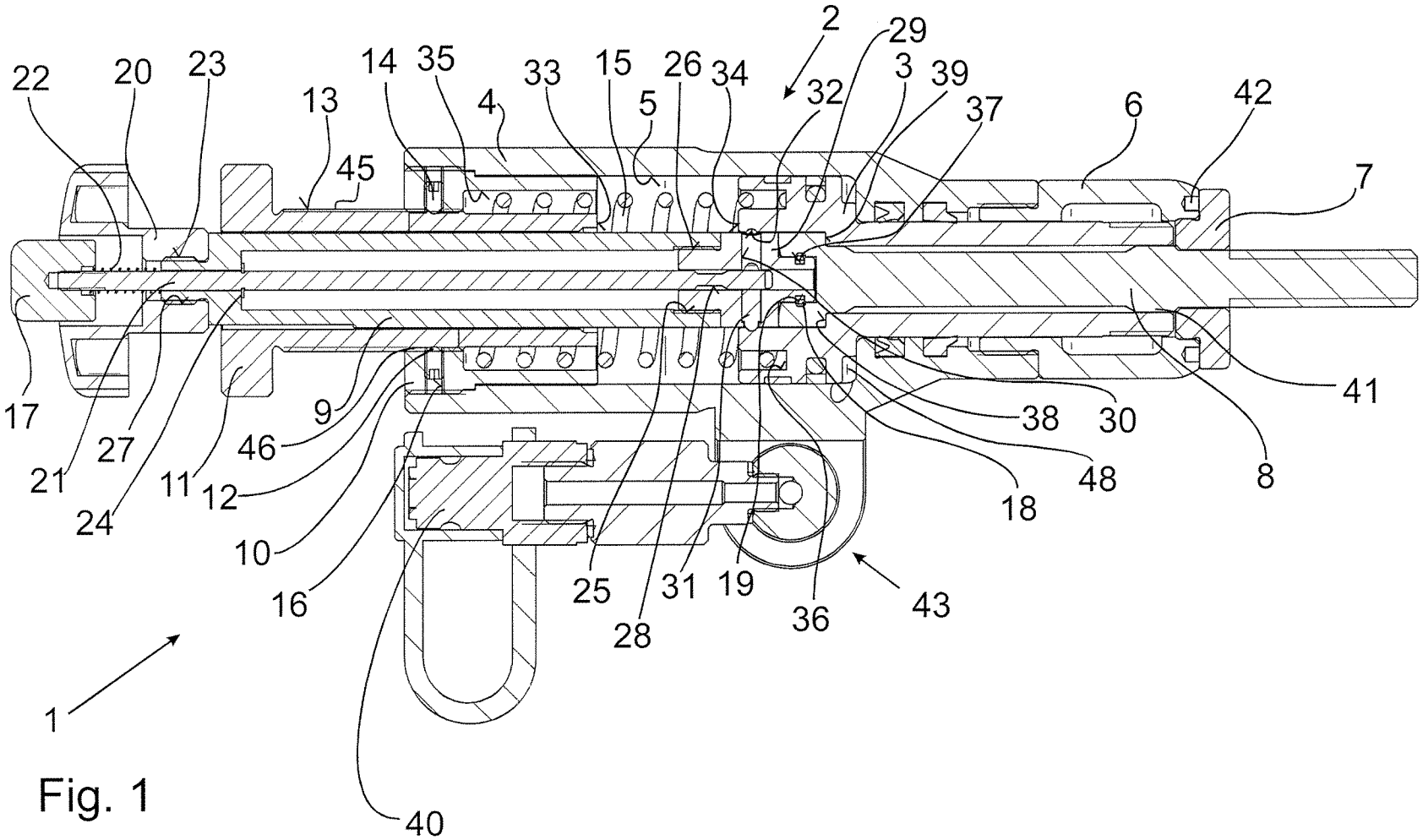
FIG. 1 shows a view of a section of a riveting tool.
Figures 2, 3:
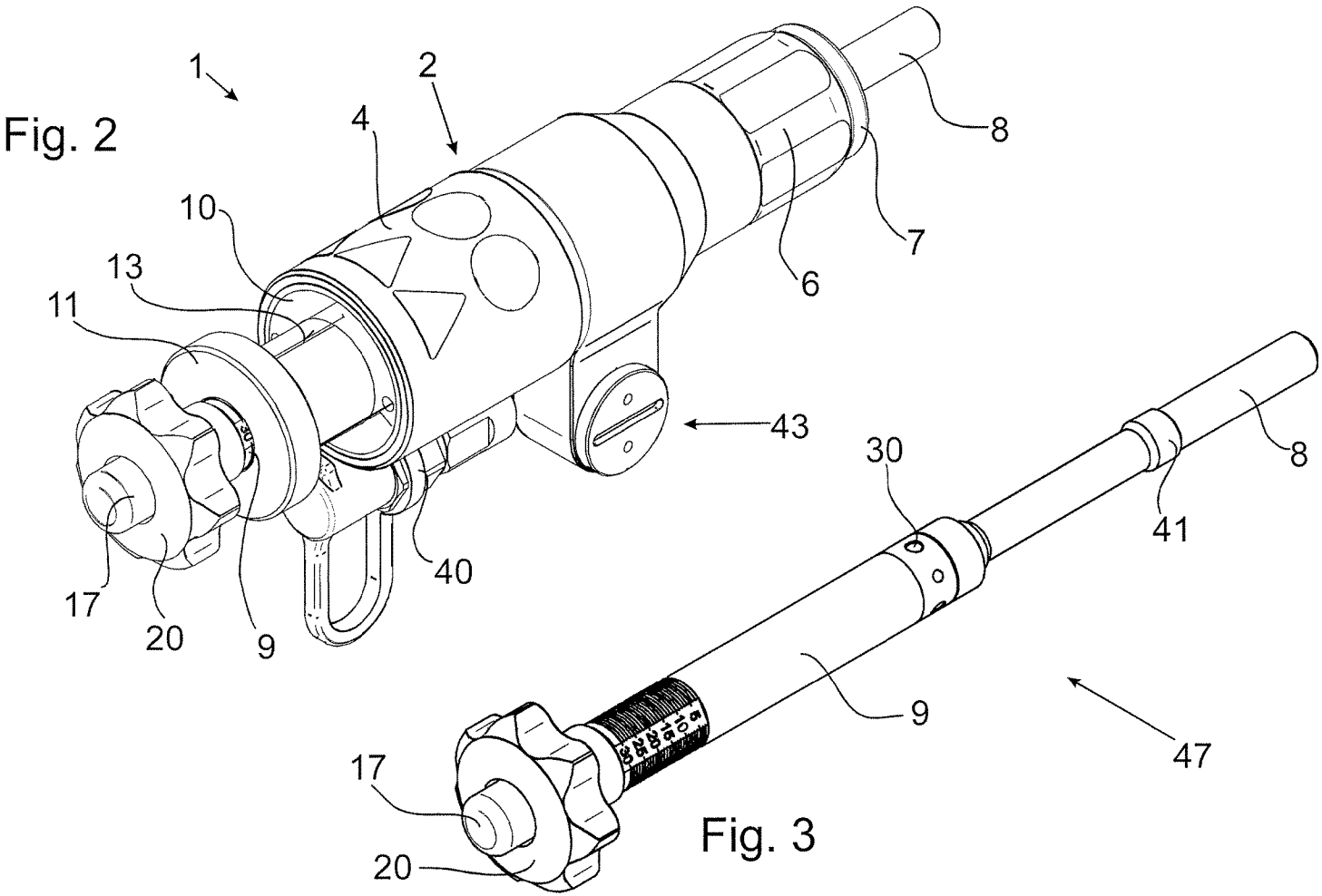
FIG. 2 shows a perspective view of the riveting tool of FIG. 1.
FIG. 3 shows a perspective view of the drawing tool of the riveting tool of FIG. 1 consisting of the drawing mandrel and pressure rod.

In FIG. 1 a riveting tool 1 comprising a drive unit 2 for a drawing tool 47 shown in FIG. 3 is shown in a sectional view. The drive unit 2 of the riveting tool 1 in this case has a drive piston 3 which is adjustable inside a cylinder portion 5 of a housing 4 of the riveting tool 1 in the longitudinal axial direction of the drive piston 3.

The adjustment of the drive piston 3 in this case takes place due to a hydraulic pressure. The hydraulic fluid required therefor is conducted via a connecting pipe 40, which is connected via a joint 43 to the housing 4, into the pressure chamber 48 of the housing 4. By the impingement of the pressure chamber 48 with hydraulic pressure, a displacement of the drive piston 3 in the longitudinal axial direction thereof takes place counter to a pretensioning applied by a helical compression spring 15, wherein to this end the helical compression spring 15 at one end is supported in a recess 36 on the drive piston 3 and at the other end is supported in a depression 35 on a latching sleeve 10 introduced into the cylinder portion 5 of the housing 4.

The drawing tool 47 inserted into the riveting tool 1 serves for connecting the riveting tool 1 to a blind rivet nut to be set, not shown here, said drawing tool substantially consisting of a drawing mandrel 8 and a pressure rod 9 releasably connected to the drawing mandrel 8. The drawing tool 47 in its position mounted on the riveting tool 1 in this case extends in the axial direction through the housing 4, as well as the longitudinally channeled drive piston 3.

In the rivet receiving position shown in FIG. 1, the drawing mandrel 8 protrudes, with its free end for arranging the blind rivet nut, out of the end of the housing 4 opposing the latching sleeve 10. The drawing mandrel 8 is located in the rivet receiving position shown in FIG. 1 in which the drive piston 3 is in its initial position, with a shoulder 39 on a pressure surface 38 of the drive piston 3. A displacement of the drive piston 3 as a result of increasing the hydraulic pressure, therefore, effects a displacement of the drawing mandrel 8 in the direction of the latching sleeve 10 according to the longitudinal adjustment of the drive piston 3.

An adjustment bush 11 screwed into the latching sleeve 10 serves for limiting the adjustment movement of the drive piston 3 and the drawing mandrel 8 and thus for fixing the setting position, said adjustment bush serving as a stroke limiting element. The adjustment bush 11 is able to be screwed via an external thread 45 into the internal thread 46 of the latching sleeve 10 and thus is able to be positioned in its longitudinal axial direction relative to the housing 4. Depending on the position of the adjustment bush 11, therefore, a stop surface 33 on the adjustment bush serves as a path limiter for a front face 34 of the drive piston 3. In the setting position, not shown here, the stop surface 33 and the front face 34 bear against one another. The adjusted position of the adjustment bush 11 in this case is secured via a suitable self-locking thread connection 45, 46.

Latching bodies 12 arranged on latching body carriers 14 in openings 16 of the latching sleeve 10 serve for haptic feedback of the adjusted position of the adjustment bush 11. In each case, after a half rotation of the adjustment bush 11 the latching bodies 12 come into engagement with latching grooves 13 extending in the longitudinal axial direction on the peripheral surface of the adjustment bush 11. In this case a half rotation corresponds to a longitudinal displacement of the adjustment bush 11 by ¼ mm.

The pressure rod 9 and the drawing mandrel 8 of the drawing tool 47 are releasably connected together via a coupling element 29 which is screwed with an external thread 26 into an opening of the pressure rod 9 provided with an internal thread 25, wherein for the releasable connection the coupling element at its end opposing the pressure rod 9 has a groove 37 with a socket retainer 18 arranged therein. In the mounted position, this socket retainer 18 engages in a groove 19 on the drawing mandrel 8 and thus releasably blocks the drawing mandrel 8 on the pressure rod 9.

In addition to the releasable arrangement of the drawing mandrel 8 on the pressure rod 9, the coupling element 29 also serves to fix the drawing tool 47 to the drive piston 3. To this end, the coupling element 29 comprises a bore 30 extending perpendicular to the longitudinal axial direction, latching pins 31 being arranged therein. In the locked position of the latching pins 31 shown in FIG. 1, said latching pins engage in a recess 32 on the drive piston 3 and thus lock the drawing tool 47 on the drive piston 3.

An unlocking rod 21 shown in FIG. 1 in the locked position prevents the latching pins 31 from moving out of the recesses 32 on the drive piston 3. For dismantling the drawing tool 47, the unlocking rod 21 is able to be displaced in the direction of the drawing mandrel 8 via a push button 17 counter to a pretensioning produced by a helical compression spring 22, wherein in the unlocked position, not shown here, a tapered portion 28 comes into engagement with the latching pins 31 and permits said latching pins to move out of the recesses 32 on the drive piston 3. In the unlocked position, therefore, the drawing tool 47 may be removed from the riveting tool 1.

The push button 17 for actuating the unlocking rod 21 in this case is displaceably mounted on a handle 20 which is screwed onto an external thread 23 of the pressure rod 9, wherein to this end the handle 20 has a correspondingly configured internal thread 27. A circlip 24 serves for limiting the movement of the unlocking rod 21 in the direction of the push button 17, said circlip in the locked position bearing against an internal surface of the pressure rod 9 extending perpendicular to the longitudinal axial direction.

The drawing mandrel 8 comprises a guide ring 41 for linear guidance, said guide ring being integrally configured with the drawing mandrel 8 and bearing against an internal surface of the drive piston 3. The drive piston 3 in this case is displaceably mounted in a guide bushing 6, wherein the guide bushing 6 is also configured with magnet holders 42 for the releasable arrangement of a setting head 7.

LIST OF REFERENCE NUMERALS

1 Riveting tool
2 Drive unit
3 Drive piston
4 Housing
5 Cylinder portion
6 Guide bushing
7 Setting head
8 Drawing mandrel
9 Pressure rod
10 Latching sleeve
11 Stroke limiting element (adjustment bush)
12 Latching body
13 Latching groove
14 Latching body carrier
15 Helical compression spring
16 Opening
17 Push button
18 Socket retainer
19 Groove (drawing mandrel)
20 Handle
21 Unlocking rod
22 Helical compression spring
23 External thread
24 Circlip
25 Internal thread
26 External thread
27 Internal thread
28 Tapered portion
29 Coupling element
30 Bore
31 Latching pins
32 Recesses
33 Stop surface
34 Front face
35 Depression
36 Recess
37 Groove
38 Pressure surface
39 Shoulder
40 Connecting pipe
41 Guide ring
42 Magnet holder
43 Joint
44 Adjusting unit
45 External thread
46 Internal thread
47 Drawing tool
48 Pressure chamber

I claim:

1. A riveting tool for setting blind rivet nuts and/or blind rivet screws, comprising a hydraulic drive piston adjustable from an initial position toward an end position in a longitudinal axial direction and a drawing mandrel in releasable and operative connection with the drive piston, wherein the drawing mandrel is movable between a rivet receiving position and a setting position by the drive piston as the drive piston moves from the initial position toward the end position, a setting unit with a stroke limiting element which is configured to be manually adjusted in the longitudinal axial direction of the drive piston, such that the stroke limiting element prevents further displacement of the drive piston as the drive piston is moved towards the end position so as to fix the setting position of the drawing mandrel.

2. The riveting tool according to claim 1, wherein the stroke limiting element is an adjustment bush adjustable in the longitudinal axial direction of the drive piston and connected to a latching sleeve fixed on a housing of the riveting tool via an external thread of the adjustment bush.

3. The riveting tool according to claim 2, wherein the adjustment bush comprises a stop surface of the adjustment bush facing the drive piston and the stop surface is configured to bear against a front face of the drive piston.

4. The riveting tool according to claim 2, wherein the adjustment bush further comprises one or more latching notches which engage with one or more latching bodies on the latching sleeve to allow for incremental adjustment of the setting position.

5. The riveting tool according to claim 4, wherein the one or more latching notches are formed by at least one latching groove extending in a longitudinal axial direction of the adjustment bush.

6. The riveting tool according to claim 2, wherein the drawing mandrel is releasably connected to a pressure rod which extends in the longitudinal axial direction of the drive piston through the adjustment bush.

7. The riveting tool according to claim 6, wherein the pressure rod at its end facing the drawing mandrel has a coupling element configured for releasable connection to the drawing mandrel.

8. The riveting tool according to claim 7, wherein the coupling element is further configured for releasable locking to the drive piston.

9. The riveting tool according to claim 8, wherein the at least one locking element is a latching pin moveable between the locked position and the unlocked position by an unlocking rod which extends through the pressure rod.

10. The riveting tool according to claim 9, wherein the unlocking rod is pretensioned toward a locked position and/or the drive piston is pretensioned toward the initial position.

11. The riveting tool according to claim 9, wherein the unlocking rod at its end opposing the coupling element comprises a handle having a push button adjustably mounted thereon, wherein the push button allows for actuation of the unlocking rod.

12. The riveting tool according to claim 1 wherein, a setting head arranged coaxially to the drawing mandrel is releasably fastened to the housing.

13. A riveting tool for setting blind rivet nuts and/or blind rivet screws, comprising a hydraulic drive piston adjustable from an initial position toward an end position in a longitudinal axial direction and a drawing mandrel in releasable and operative connection with the drive piston, and movable between a rivet receiving position and a setting position by the drive piston as the drive piston moves from the initial position toward the end position, a setting unit with a stroke limiting element that is configured to be manually adjusted in the longitudinal axial direction of the drive piston, such that the stroke limiting element prevents further displacement of the drive piston as the drive piston is moved towards the end position so as to fix the setting position of the drawing mandrel, and wherein the stroke limiting element is an adjustment bush that is adjustable in the longitudinal axial direction of the drive piston and is connected to a latching sleeve fixed on a housing of the riveting tool via an external thread of the adjustment bush.

14. The riveting tool according to claim 3, wherein the stop surface of the adjustment bush comprises a coating configured to dampen contact between the drive piston and the adjustment bush.

15. The riveting tool according to claim 7, wherein the coupling element comprises a socket retainer arranged in a groove on the pressure rod and which engages in a groove on the drawing mandrel.

16. The riveting tool according to claim 8, wherein the coupling element comprises at least one locking element which is adjustable between a locked position and an unlocked position.

17. The riveting tool according to claim 12, wherein the setting head is magnetically releasably fastened to the housing.

* * * * *